US005353869A

United States Patent [19]

Allen

[11] Patent Number: 5,353,869

[45] Date of Patent: Oct. 11, 1994

[54] METHOD AND APPARATUS FOR PRODUCING EXCESSIVELY HOT HYDROGEOTHERMAL FLUIDS

[75] Inventor: William C. Allen, Pasadena, Calif.

[73] Assignee: Union Oil Company of California, Los Angeles, Calif.

[21] Appl. No.: 30,795

[22] Filed: Mar. 12, 1993

[51] Int. Cl.[5] ..... E21B 36/00; E21B 43/00

[52] U.S. Cl. ..... 166/302; 166/57; 166/371

[58] Field of Search ..... 166/302, 57, 261, 371, 166/310

[56] References Cited

U.S. PATENT DOCUMENTS

| | | | |
|---|---|---|---|
| 3,250,327 | 5/1966 | Crider | 166/302 X |
| 3,685,583 | 8/1972 | Phares | 166/302 |
| 3,908,380 | 9/1975 | Lobach | 60/641 |
| 3,910,050 | 10/1975 | Matthews et al. | 60/641 |
| 3,938,592 | 2/1976 | Aladier et al. | 166/302 X |
| 4,030,549 | 6/1977 | Bouch | 166/302 X |
| 4,032,460 | 6/1977 | Zilch et al. | 166/310 X |
| 4,125,289 | 11/1978 | Huff et al. | 166/302 X |
| 4,228,856 | 10/1980 | Reale | 166/302 X |
| 4,343,999 | 8/1982 | Wolf | 290/2 |
| 4,454,914 | 6/1984 | Watanabe | 166/266 X |
| 4,476,930 | 10/1984 | Watanabe | 166/371 X |
| 4,492,083 | 1/1985 | McCabe et al. | 166/371 X |
| 4,598,772 | 7/1986 | Holmes | 166/261 X |
| 4,655,287 | 4/1987 | Wu | 166/371 X |
| 4,787,450 | 11/1988 | Andersen et al. | 166/267 |
| 5,044,439 | 9/1991 | Cenegy et al. | 166/371 X |

*Primary Examiner*—Hoang C. Dang
*Attorney, Agent, or Firm*—Gregory F. Wirzbicki; Shlomo R. Frieman

[57] ABSTRACT

A method and system, for reducing the temperature of a hydrogeothermal fluid, entails directly or indirectly contacting a self-rising, heated hydrogeothermal fluid with a cooling fluid to cool the hydrogeothermal fluid before it enters and/or as it rises in the production tube.

6 Claims, 3 Drawing Sheets

METHOD AND APPARATUS FOR PRODUCING EXCESSIVELY HOT HYDROGEOTHERMAL FLUIDS

BACKGROUND

The present invention relates to procedures and systems for producing hydrogeothermal fluids.

Hydrogeothermal fluids can adversely affect hardware (e.g., tubing) which contact and/or convey the fluids during their production. The severity of the problem increases as the temperature, salinity, and corrosive ingredient content of the fluid increase. Various techniques (e.g., use of expensive alloy tubing, frequent tubing changes) have been developed over a long period of time in an attempt to solve this problem in a safe and cost effective manner.

SUMMARY

There is a need for a technique and a system for producing hydrogeothermal fluids in a safer and even more cost effective manner—especially in environments where the hardware is exposed to temperatures greater than about 273.9° C. (525° F.). The present invention satisfies this need by providing a process and a system for reducing the temperature of a produced hydrogeothermal fluid. In one embodiment of the invention, the method comprises the steps of (a) contacting a self-rising, heated hydrogeothermal fluid with a cooling fluid proximate to or below the intake portion of a production tubing, which is axially positioned within a well casing of a production well, to cool the hydrogeothermal fluid rising in the production tubing, and (b) producing the cooled hydrogeothermal fluid from the production well. The cooling fluid reduces the temperature of the hydrogeothermal fluid by one or more of three mechanisms, namely, (a) heat uptake from the hydrogeothermal fluid without the cooling fluid changing its phase, (b) heat absorption by the cooling fluid changing phases from a liquid to a gas, and (c) enhancing the flash of the hydrogeothermal fluid as it is produced from the subterranean formation.

In another embodiment of the invention, the method comprises the steps of (a) contacting a portion of a production tubing within a geothermal production well with a heat exchange fluid to cool a self-rising hydrogeothermal fluid being produced through the production tubing and to form a heated heat exchange fluid; (b) cooling the heated heat exchange fluid to form a cooled heat exchange fluid; and (c) employing the cooled heat exchange fluid formed in step (b) as the heat exchange fluid used in step (a).

The invention also provides a system for producing hydrogeothermal fluids. One exemplary hydrogeothermal system comprises (a) a production borehole penetrating a hydrogeothermal-containing subterranean formation and having an opening proximate the surface of the ground, the subterranean formation being substantially devoid of oil and natural gas; (b) a production tubing axially positioned within the production borehole, the production tubing having an intake end located downhole in the production borehole and an exit end located proximate surface of the ground; (c) a hydrogeothermal fluid located within the production borehole; and (d) an injection borehole intersecting the production borehole for injecting a cooling fluid into the subterranean formation proximate the intake end of the production tubing.

DRAWINGS

The reduction in hydrogeothermal fluid temperature and other features, aspects, and advantages of the present invention will become better understood with reference to the following description, appended claims, and accompanying drawings wherein like reference numerals refer to like elements and where:

DETAILED DESCRIPTION OF THE INVENTION

Figure 1:
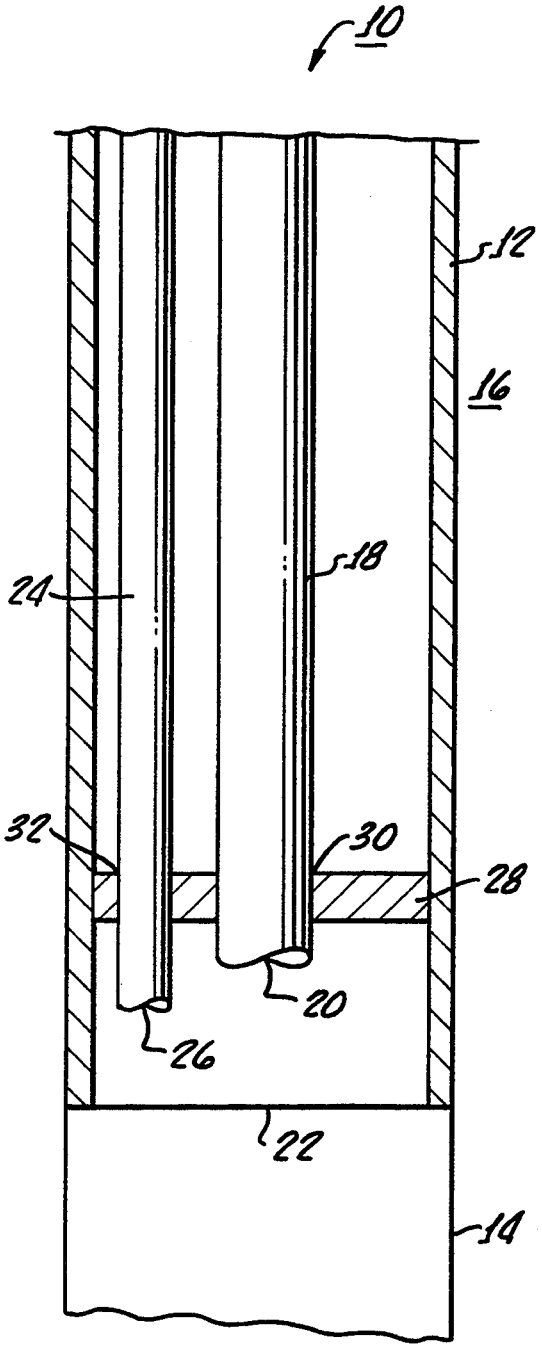
FIG. 1 is an elevation view partially in cross section of one system employed in the process for reducing the temperature of a produced hydrogeothermal fluid.

The present invention employs a fluid to reduce the temperature of a self-rising hydrogeothermal fluid produced from a subterranean formation. (As used in the specification and claims, the term "self-rising hydrogeothermal fluid" means a hydrogeothermal fluid that can be produced through a production well from a subterranean formation without the use of a gas-lift, a pump, or other non-endogenous means to raise the hydrogeothermal fluid from the subterranean formation to ground level.) As shown in FIG. 1, an exemplary system 10 of the present invention comprises a well casing 12 positioned within a borehole 14 that penetrates into at least a portion of a subterranean formation 16. Axially positioned within the well casing 12 is a production tube 18 having an intake end 20 terminating proximate the downhole end 22 of the well casing 12. Located within, and generally running parallel to the axis of, the well casing 12 is an injection tube 24 having an exit end 26 terminating proximate the downhole end 22 of the well casing 12. A packer 28 is set in the well casing 12, with the production tube 18 and the injection tube 24 respectively transversing openings 30 and 32 in the packer 28.

In the system 10 shown in FIG. 1, a hydrogeothermal fluid is produced through the production tube 18 in production well 12. Some hydrogeothermal fluids have an in situ temperature (i.e., an endogenous subterranean temperature) greater than about 273.9° C. (525° F.). For example, the in situ temperature of hydrogeothermal fluids can be about 287.8° C. (550° F.), about 315.6° C. (600° F.) , about 343.3° C. (650° F.) , or even about 371.1° C. (700° F.) or hotter.

To avoid or minimize the need to employ expensive, special alloys for the well casing 12 and other materials that contact such excessively hot hydrogeothermal fluids, in accordance with the present invention, a fluid is injected through the injection tube 24 to contact, intermingle with, and cool the hydrogeothermal fluid entering the production tube 18. Preferably, the fluid is injected at a sufficient rate through the injection tube 24 to drop the temperature of the hydrogeothermal fluid entering the production tube 18 to less than about 273.9°

C. (525° F.) and more preferably less than about 260° C. (500° F.). In fact, for some hydrogeothermal systems it may be desirable to inject fluid at a sufficient rate through the injection tube 24 to drop the temperature of the hydrogeothermal fluid entering the production tube 18 to less than about 246.1° C. (475° F.), or less than about 232.2° C. (450° F.), or about 218.3° C. (425° F.) or less. Preferably, the temperature of the hydrogeothermal fluid is not dropped below that needed to ensure maintenance of the natural lift (i.e., the reduced temperature of the hydrogeothermal fluid is at least sufficient for the hydrogeothermal fluid to still be self-rising).

Generally, an inert gas and/or an inert liquid is employed as the injected fluid. The inert gases reduce the temperature of the hydrogeothermal fluid by providing space into which the hydrogeothermal fluid flashes. Exemplary inert gases are nitrogen, the noble gases (e.g., helium, neon, and argon), and hydrocarbon gases containing 1 to about 4 carbon atoms (e.g., methane, ethane, propane, butane, and isobutane).

The inert liquids reduce the temperature of the hydrogeothermal fluid by commingling with, and absorbing heat from, the hydrogeothermal fluid. Typical inert liquids are water and liquid hydrocarbons (e.g., oil).

In addition to commingling with, and absorbing heat from, the hydrogeothermal fluid, some liquids further cool the hydrogeothermal fluid by (a) absorbing further heat from the hydrogeothermal fluid upon changing from a liquid to a gas at the down hole conditions in the presence of the hydrogeothermal fluid and (b) the subsequent gas facilitating the hydrogeothermal fluid to flash in, or as it is produced from, the subterranean formation. Examples of such liquids are listed in the following Table I:

TABLE I

Liquids that flash at a temperature of about 343.3° to about 398.9° C. (650° to 750° F.) and about 6996.1 kpascal (1,000 psia):

2,2,4,4-tetramethylpentane
2,2,3,3-tetramethylbutane
di-isobutyl-2,5-dimethylhexane
iso-octane-2,2,4-trimethylpentane
heptane
octane Liquids that flash at a temperature of about 287.8° to about 343.3° C. (550° to 650° F.) and about 6996.1 kpascal (1,000 psia):

neohexane
2,2-dimethylbutane
di-isopropyl
2,3-dimethylbutane
2-methylpentane
3-methylpentane
hexane Liquids that flash at a temperature of about 232.2° to about 260° C. (450° to 500° F.) and about 6996.1 kpascal (1,000 psia):

neopentane
2,2-dimethylpropane
isopentane
2-methylbutane
pentane

The preferred gas is nitrogen and the preferred liquid is water.

Figure 2:
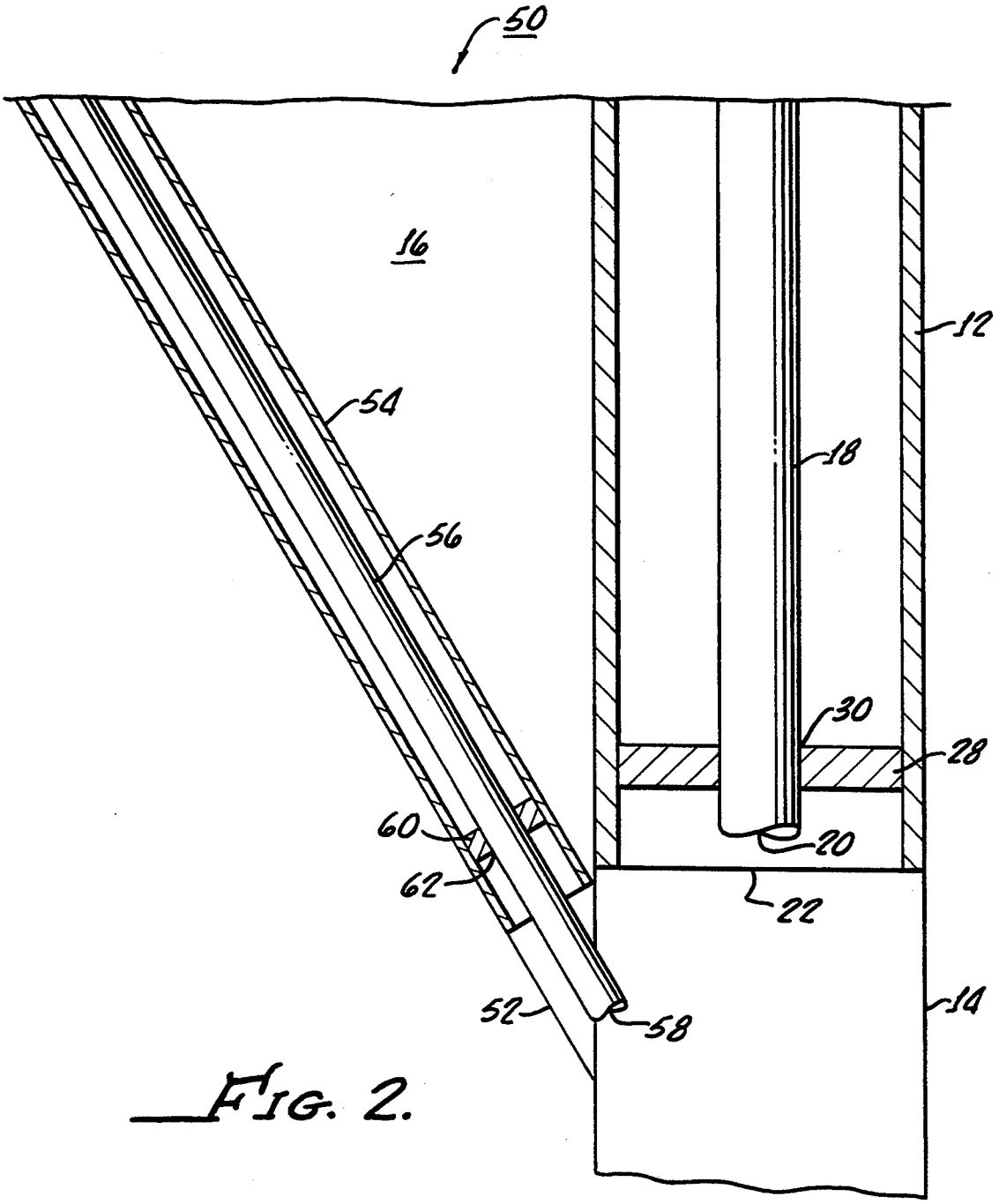
FIG. 2 is an elevation view partially in cross section of another system employed in the process for reducing the temperature of a produced hydrogeothermal fluid.

As shown in FIG. 2, another system 50 of the present invention comprises a production well casing 12 positioned in a production borehole 14 which penetrates at least a portion of a subterranean formation 16. Axially positioned in the production well casing 12 is a production tube 18 having an intake end 20 terminating proximate the downhole end 22 of the production well casing 12. A packer 28 is set in the production well casing 12, with the production tube 18 transversing an opening 30 in the packer 28. Intersecting the production borehole 14 is an injection borehole 52. An injection well casing 54 is positioned in the injection borehole 52. Axially positioned within the injection well casing 54 is an injection tube 56 having an exit end 58 terminating proximate the intersection of the production borehole 14 and the injection borehole 52. A packer 60 is set in the injection well casing 54, with the injection tube 56 transversing an opening 62 in the packer 60.

In the system 50 shown in FIG. 2, a fluid is injected through the injection tube 56 to cool the hydrogeothermal fluid entering the production tube 18. Preferably, the fluid is injected at a sufficient rate through the injection tube 56 to drop the temperature of the hydrogeothermal fluid entering the production tube 18 to less than about 273.9° C. (525° F.).

Figure 3:
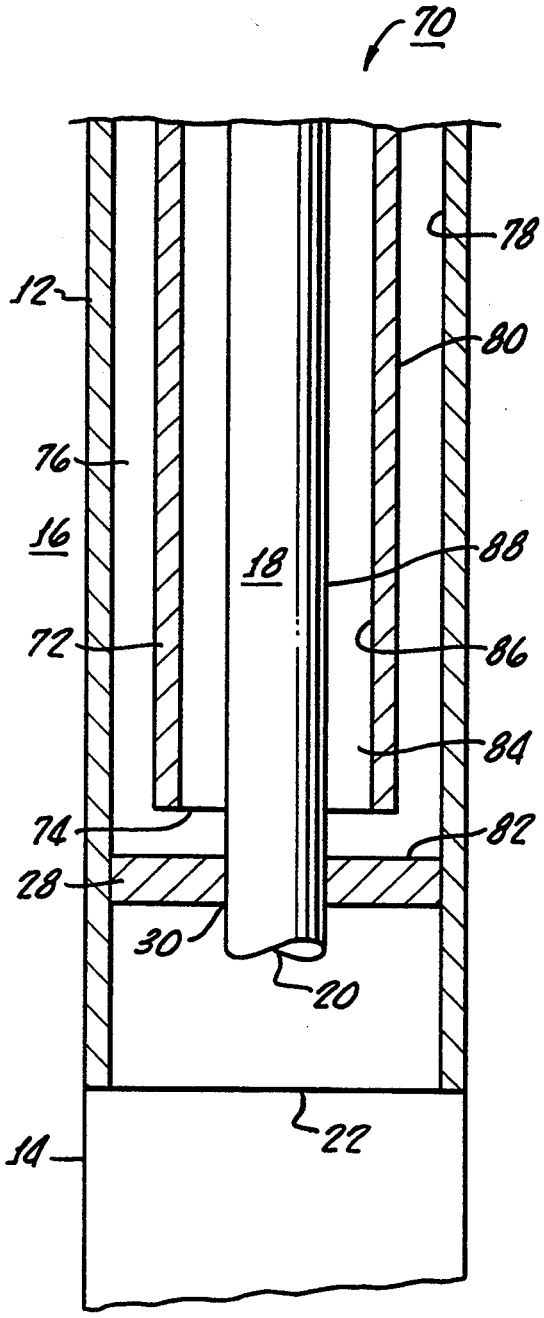
FIG. 3 is an elevation view partially in cross section of yet another system employed in the process for reducing the temperature of a produced hydrogeothermal fluid.

In yet another embodiment of the invention as shown in FIG. 3, the system 70 comprises a well casing 12 positioned in a borehole 14 which penetrates at least a portion of a subterranean formation 16. Axially positioned in the well casing 12 is an intermediate casing 72 and a production tube 18 axially located within the intermediate casing 72. The production tube 18 has an intake end 20 terminating proximate the downhole end 22 of the well casing 12. A packer 28 is set in the well casing 12, with the production tube 18 transversing an opening 30 in the packer 28. The intermediate casing 72 has a downhole end 74 that terminates above the packer 28.

In the system 70 as shown in FIG. 3, a heat exchange fluid is pumped into the outer conduit 76 formed between the inner surface 78 of the well casing 12 and the outer surface 80 of the intermediate casing 72. Exemplary heat exchange fluids are water, steam, and organic liquids (e.g., organic compounds having about 5 to about 18 carbon atoms) and gases (e.g., organic compounds containing up to about 4 carbon atoms), with the preferred heat exchange fluid being a liquid, namely, water.

The injected heat exchange fluid descends to the upper surface 82 of the packer 28, turns around the downhole end 74 of the intermediate casing 72, and then ascends upward in the inner conduit 84 formed by the inner surface 86 of the intermediate casing 72 and the outer surface 88 of the production tube 18. As the exchange fluid rises in the inner conduit 84, heat is transferred to it from the hydrogeothermal fluid being produced in the production tube 18. Hence, the produced hydrogeothermal fluid is cooled as it moves upward in the production tube 18, and the heat exchange fluid is heated as it descends in the outer conduit 76 and rises in the inner conduit 84. The heated heat exchange fluid exiting the inner conduit 84 is cooled at a ground surface facility (not shown) by any one of a number of techniques known to those skilled in the art, with the cooled heat exchange fluid being reintroduced into the outer conduit 79. For example, the heated heat exchange fluid can be cooled by extracting energy from it for power production.

Because the hydrogeothermal fluid is not cooled prior to entering the production tube 18 in the system 70 shown in FIG. 3, a length of the production tube 18 at the intake end 20 is preferably formed of special alloy to withstand the rigors of contacting the excessively hot hydrogeothermal fluid entering the production tube 18. Examples of such alloys include, but are not limited to, titanium alloys and high nickel-, chromium-, and molybdenum-containing materials such as Hastelloy brand alloys. (Hastelloy is a trademark of Cabot Corp., Kokomo, Ind.) The length of tubing made of one or more of such alloy materials is preferably sufficient so that the portion of the production tube 18 fabricated from conventional materials contacts only fluids having a temperature less than about 273.9° C. (525° F.).

EXAMPLE

The following example—which is intended to illustrate and not limit the invention—exemplifies one method for practicing the present invention.

EXAMPLE 1

Figure 4:
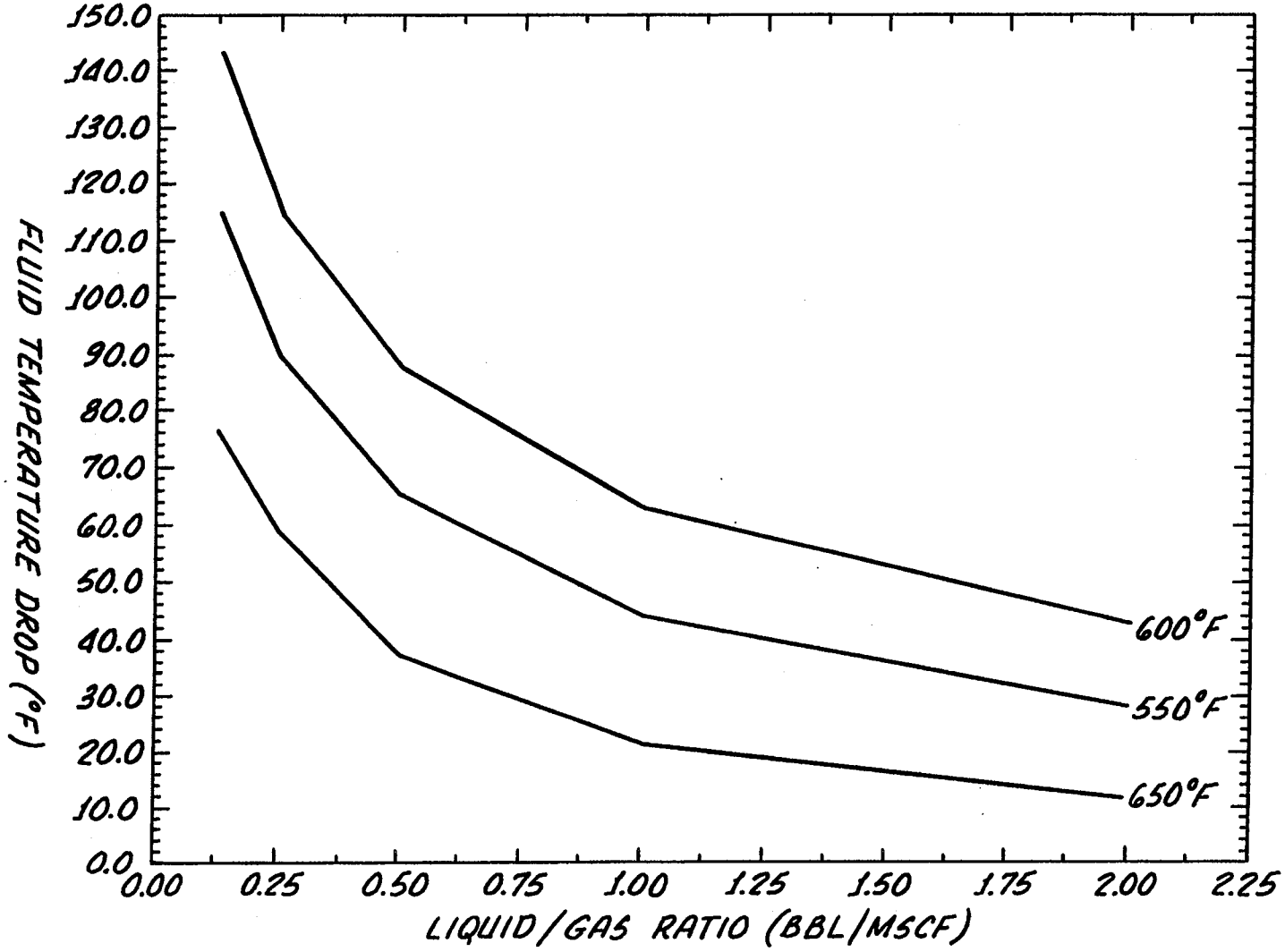
FIG. 4 is a graph depicting fluid temperature drops associated with mixing water and nitrogen at about 13890.8 kpascal (2000 psia) in various ratios and at several temperatures.

Substantially pure water is confined in a subterranean formation at a pressure of about 13890.8 kpascal (2000 psia) and a temperature of about 315.6° C. (600° F.). If 3,815,717 liters (1) (24,000 barrels (bbl)) of the water are contacted with 96,000 thousand standard cubic feet (MSCF) of nitrogen also at a pressure of about 13890.8 kpascal (2000 psia) and a temperature of about 315.6° C. (600° F.) (the liquid/gas ratio would be about 0.25 bbl/MSCF), as shown in FIG. 4, the resulting isobaric gas-water mixture would be about 63.3° C. (114° F.) cooler. Hence, the resulting isobaric gas-water mixture would be at a temperature of about 252.2° C. (486° F.).

For a dynamic system, rate calculations would have to be employed. For example, when substantially pure water (at a pressure of about 13890.8 kpascal (2000 psia) and a temperature of about 315.6° C. (600° F.)) being produced from a subterranean formation at a rate of about 158,988.2 l/hr (1,000 bbls/hr) is mixed with about 4,000 MSCF/hr of nitrogen (at a pressure of about 13890.8 kpascal (2000 psia) and a temperature of about 315.6° C. (600° F.)), the liquid/gas ratio is also about 0.25 bbl/MSCF. Hence, the resulting isobaric gas-water mixture would also be about 63.3° C. (114° F.) cooler (namely, at a temperature of about 252.2° C. (486° F.)) once equilibrium conditions are established.

As shown in FIG. 4, the cooling effect upon mixing nitrogen and water at a pressure of about 13890.8 kpascal (2000 psia) goes through a maximum between about 287.8° to about 343.3° C. (550° to 650° F.) due to, among other things, a reduction in the latent heat of vaporization as the critical point of water is approached.

Although the present invention has been described in detail with reference to some preferred embodiments, other embodiments are possible. For example, a fluid can be injected into one or more locations along the production tube 18 to cool the rising hydrogeothermal fluid. In this embodiment, the fluid is preferably injected in the lower half, more preferably, the lower quarter, even more preferably the lower 10 percent, and most preferably the lower 1 percent, of the production tube 18. In addition, in FIG. 2, the injection tube 56 and packer 60 need not be present in the injection well casing 54. Also, in FIG. 1, the outside surface of the injection tube 24 and/or the outside surface of the production tube 18 can optionally be covered with insulation (not shown) to diminish and/or control the rate of heat transfer to the cooling fluid descending in the injection tube 24. Likewise, in FIG. 3, the outside surface 80 and/or the inside surface 86 of the intermediate casing 72 can optionally be covered with insulation (not shown) to diminish and/or control the rate of heat transfer to the cooling fluid descending in the outer conduit 76. Furthermore, for increasing heat exchange efficiency in the system 70 of FIG. 3, the outer surface of the production tube 18 can be fluted and/or hardware (e.g., in situ mixers (not shown)) can optionally be located in the outer conduit 76 and/or the inner conduit 84. Therefore, the spirit and scope of the appended claims should not necessarily be limited to the description of the preferred versions contained herein.

What is claimed is:

1. A method for reducing the temperature of a produced hydrogeothermal fluid, the method comprising the steps of:

(a) contacting a self-rising, heated hydrogeothermal fluid with a cooling fluid proximate to or below the intake portion of a production tubing to cool the hydrogeothermal fluid rising in the production tubing, at least a portion of the production tubing being axially positioned within a well casing of a production well; and (b) producing the cooled hydrogeothermal fluid from the production well, wherein step (a) includes the step of introducing the cooling fluid through an injection well that intersects the well bore of the production well.

2. The method of claim 1 wherein the cooling fluid comprises a gas.

3. The method of claim 1 wherein the cooling fluid comprises a gas selected from the group consisting of nitrogen, noble gases, hydrocarbon gases containing 1 to about 5 carbon atoms, and mixtures thereof.

4. The method of claims 1 wherein the cooling fluid comprises nitrogen.

5. The method of claim 1 wherein the cooling fluid comprises a liquid.

6. A hydrogeothermal system comprising:

(a) a production borehole penetrating at least a portion of a hydrogeothermal-containing subterranean formation and having an opening proximate the surface of the ground, the subterranean formation being substantially devoid of oil and natural gas;

(b) a production tubing axially positioned within at least a portion of the production borehole, the production tubing having an intake end located downhole in the production borehole and an exit end located proximate surface of the ground;

(c) a hydrogeothermal fluid located within at least a portion of the production borehole; and (d) an injection borehole intersecting the production borehole.

* * * * *